US007228937B2

(12) United States Patent
Morris

(10) Patent No.: US 7,228,937 B2
(45) Date of Patent: Jun. 12, 2007

(54) SCAFFOLD SAFETY RAILING DEVICE

(76) Inventor: Michael John Morris, 30 S. Maple Ave., Port Jervis, NY (US) 12771

( * ) Notice: Subject to any disclaimer, the term of this patent is extended or adjusted under 35 U.S.C. 154(b) by 228 days.

(21) Appl. No.: 10/947,522

(22) Filed: Sep. 22, 2004

(65) Prior Publication Data

US 2005/0061581 A1 Mar. 24, 2005

(51) Int. Cl.
*E04G 1/20* (2006.01)

(52) U.S. Cl. ..... 182/82; 182/146; 403/385

(58) Field of Classification Search ..... 182/113, 182/82, 146; 403/385
See application file for complete search history.

(56) References Cited

U.S. PATENT DOCUMENTS 2,722,440 A * 11/1955 Percy ..... 403/385
4,432,435 A * 2/1984 Anderson ..... 182/82
4,566,819 A * 1/1986 Johnston ..... 403/385
5,143,413 A * 9/1992 Vandenhoek ..... 292/302
5,307,899 A * 5/1994 Lubinski ..... 182/136

* cited by examiner

*Primary Examiner*—Alvin Chin-Shue
(74) *Attorney, Agent, or Firm*—Steven B. Stein

(57) ABSTRACT

The present invention provides a support clamp device for a safety rail or similar device adapted for mounting on a pump jack pole comprising: a first pole clamp, circumscribing a generally rectangular perimeter, the first pole clamp comprising a generally U-shaped bar having a first side; a second side and a third side, wherein the first and third sides are approximately parallel to each other and the second side is approximately perpendicular to the first and third sides and wherein the second side further comprises an aperture; and a fourth side removably attached to the first and third sides opposite and approximately parallel the second side; and a second pole clamp, circumscribing a generally rectangular perimeter, the second pole clamp comprising a generally U-shaped bar having a first side; a second side and a third side, and a pole clamp connecting fastening means, the first pole clamp and the second pole clamp are able to pivotably rotate about the axis formed by the pole clamp connecting fastener.

17 Claims, 5 Drawing Sheets

910
911
912

710
711
615
612
601
630
610
611
901
910
1

911
512
520
521
501
513
711
701
710
511
712
510
530

SCAFFOLD SAFETY RAILING DEVICE

Throughout this application, various publications are referenced. Full citations for these publications may be found listed at the end of the specification and preceding the Claims. The disclosures of these publications in their entireties are hereby incorporated by reference into this application in order to more fully describe the state of the art.

FIELD OF THE INVENTION

The present invention involves the field of scaffolding devices in general and specifically relates to a method and device for securing a safety rail to a scaffold support. According to an embodiment of this invention, the device comprises a metal coupling device. The invention further comprises pivotable connector permitting two coupling devices to be joined in perpendicular planes. According to a further embodiment of the invention, a vertical spacer provides stabilization in the vertical plane. According to a preferred embodiment of the invention the coupling device is capable of stably positioning a safety rail to a scaffold support.

The present invention solves the long-standing problem of the need for an easy method to secure a safety rail to a scaffold support. The present invention facilitates a safe method to stably position a safety rail to a scaffold support.

BACKGROUND OF THE INVENTION

The present invention provides a scaffold safety rail capable of vertical adjustment in coordination with the scaffold platform.

Examples of devices for scaffold systems are well known in the art. Further, modular scaffold devices are known in the art. Still further, devices for attaching a safety rail to a scaffold are known in the art. In most cases, however, these devices are cumbersome to use and take time to reset and reposition. While useful for providing a worker with a safer environment while working on a scaffold platform, they fail to provide a quick and easy way for a worker to rapidly reposition and reset the safety rail relative to a repositioned scaffold, particularly in the vertical plane and at various particular vertical positions. In particular, the prior art devices use complicated mounting arrangements and complicated lifting mechanisms. Other prior art devices are subject to moving out of position because they are cannot be securely mounted. Still other prior art devices, once mounted, impede easy and variable height adjustment. Importantly, the prior art devices fail to provide a vertically slidable safety rail device capable of being simultaneously adjusted together with the scaffold platform. The present invention solves the problems of the prior art.

SUMMARY OF THE INVENTION

It is therefore an object of the present invention to provide a support clamp device for a safety rail or similar device adapted for mounting on a pump jack pole comprising a first pole clamp, circumscribing a generally rectangular perimeter, the first pole clamp comprising a generally U-shaped bar having a first side; a second side and a third side, wherein the first and third sides are approximately parallel to each other and the second side is approximately perpendicular to the first and third sides and wherein the second side further comprises an aperture; and a fourth side removably attached to the first and third sides opposite and approximately parallel the second side; and a second pole clamp, circumscribing a generally rectangular perimeter, the second pole clamp comprising a generally U-shaped bar having a first side; a second side and a third side, wherein the first and third sides are approximately parallel to each other and the second side is approximately perpendicular to the first and third sides and wherein the second side further comprises an aperture; and a fourth side removably attached to the first and third sides opposite and approximately parallel the second side; and a pole clamp connecting fastening means stably inserted through the aperture of the second side of the first pole clamp and through the aperture of the second side of the second pole clamp, wherein the first pole clamp and the second pole clamp are able to pivotably rotate about the axis formed by the pole clamp connecting fastener.

BRIEF DESCRIPTION OF THE DRAWINGS

FIG. 4A. View of the scaffold safety railing support clamp device 1 separately showing a first pole clamp and a second pole clamp with an adjustment means. FIG. 4B. Showing a preferred embodiment of a fastening means, the pole clamp-connecting fastener.

DETAILED DESCRIPTION

Figure 1:
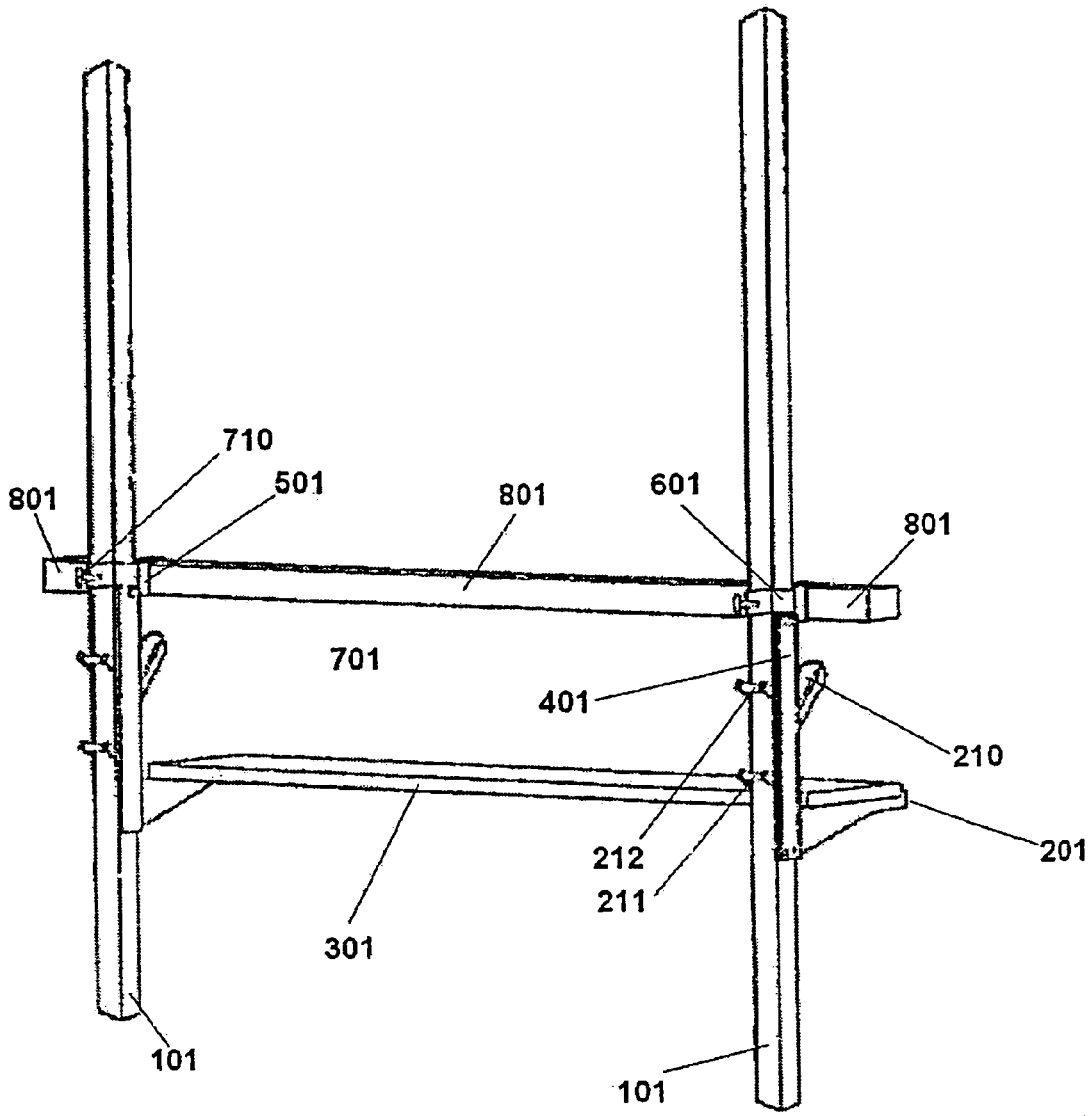
FIG. 1: Front view of scaffolding system showing the provided scaffold safety railing device.

The present invention provides a support clamp device for a scaffold safety rail device adapted for mounting on a pump jack pole comprising a first pole clamp, circumscribing a generally rectangular perimeter, the first pole clamp comprising a generally U-shaped bar having a first side; a second side and a third side, wherein the first and third sides are approximately parallel to each other and the second side is approximately perpendicular to the first and third sides and wherein the second side further comprises an aperture; and a fourth side removably attached to the first and third sides opposite and approximately parallel the second side; and a second pole clamp, circumscribing a generally rectangular perimeter, the second pole clamp comprising a generally U-shaped bar having a first side; a second side and a third side, wherein the first and third sides are approximately parallel to each other and the second side is approximately perpendicular to the first and third sides and wherein the second side further comprises an aperture; and a fourth side removably attached to the first and third sides opposite and approximately parallel the second side; and a pole clamp connecting fastening means stably inserted through the aperture of the second side of the first pole clamp and through the aperture of the second side of the second pole clamp, wherein the first pole clamp and the second pole clamp are able to pivotably rotate about the axis formed by the pole clamp connecting fastener.

According to an embodiment of this invention, the support clamp device further comprises a vertical spacer, wherein the spacer has an scaffold joining end and a support clamp joining end, wherein the support clamp joining end is joined to the support clamp device in a position between the fourth side of the first pole clamp and the fourth side of the second pole clamp and the scaffold joining end extends away from the support clamp device. According to another embodiment of this invention, the vertical spacer is stably attached to the provided support clamp device. It is contemplated that the vertical spacer may be fastened by means of a bolt, screw, nail, weld, glue or other means. According to yet another embodiment of this invention, the vertical spacer further comprises a plurality of apertures. It is contemplated that the apertures are capable of accommodating a variety of fastening devices, positioned along the length of the vertical spacer, thereby facilitating positional adjustment for different scaffolding systems. According to another embodiment, the vertical spacer is reversibly attached to the support clamp device. According to a preferred embodiment of this invention, the vertical spacer is comprised of metal. According to a most preferred embodiment of this invention, the vertical spacer is comprised of steel. However, it is also contemplated that the spacer may be comprised of a variety of sturdy materials such as wood, plastic, composite, natural or synthetic materials.

According to another embodiment of the invention, the fourth side of the first pole clamp further comprises an aperture. It is contemplated that the aperture may accommodate an adjustment means. A preferred embodiment of this invention further comprises a adjusting means, wherein the adjusting means comprises a threaded member having an approximately flat abutment end and an opposite handle end, wherein the adjusting means is threaded through the aperture and is capable of tightening the support clamp about a beam. It is specifically contemplated that a variety of adjustment means are suitable including ratchetable devices, screwable devices and pressure clampable devices.

According to another embodiment of the invention, the fourth side of the first pole clamp further comprises a hinge at one connected to the third side of the first pole clamp and a latch at the opposite end capable of stably hooking an aperture on the first side of the first pole clamp, facilitating the opening of the fourth side of the first pole through an angle from approximately perpendicular to the third side of the first pole clamp through an angle approximately parallel to the third side of the first pole clamp. Various hinge means are well known in the art. According to a preferred embodiment of the invention, the fastening means is a nut and bolt. According to another preferred embodiment of the invention, the fastening means is a rivet. According to a most preferred embodiment of the invention, the fastening means is a pin with a cotter pin.

The present invention provides a scaffold safety railing system assembly comprising at least two vertical support poles; a safety rail comprising a first end and a second end; at least two support clamp devices as provided by the present invention, wherein one vertical support pole is inserted through one first pole clamp and a second vertical support pole is inserted through a second first pole clamp and wherein the first end of the safety rail is inserted through one second pole clamp and the second end of the safety rail is inserted through the second second pole clamp.

According to an embodiment of this invention, the provided safety railing assembly further comprises a pair of pump jack hoisting apparatus, wherein each pump jack apparatus is mounted on a compatible vertical support pole. According to another embodiment of this invention, the provided safety railing assembly further comprises a vertical spacer, wherein the spacer is vertically connected between the pump jack and the support clamp device, stabilizing the position between the support clamp device and the pump jack assembly. Pump jack systems are known in the art. In particular, pump jacks normally include a pedal or lever operated crank to elevate the pump jack along the vertical pole and often have hand-operated cranks that permit lowering of the jack and its supported scaffold platform. According to a preferred embodiment of this invention the spacer is metal. According to a most preferred embodiment of this invention, the vertical spacer is comprised of steel. However, it is also contemplated that the spacer may be comprised of a variety of sturdy materials such as wood, plastic, composite, natural or synthetic materials. According to one embodiment of this invention, the safety rail is metal. According to a most preferred embodiment, the safety rail is aluminum. According to another embodiment of this invention, the safety rail is wood. According to still another embodiment of this invention the safety rail is plastic. However, it is also contemplated that the safety railing may be comprised of a variety of sturdy materials such as wood, plastic, composite, natural or synthetic materials.

Figure 2:
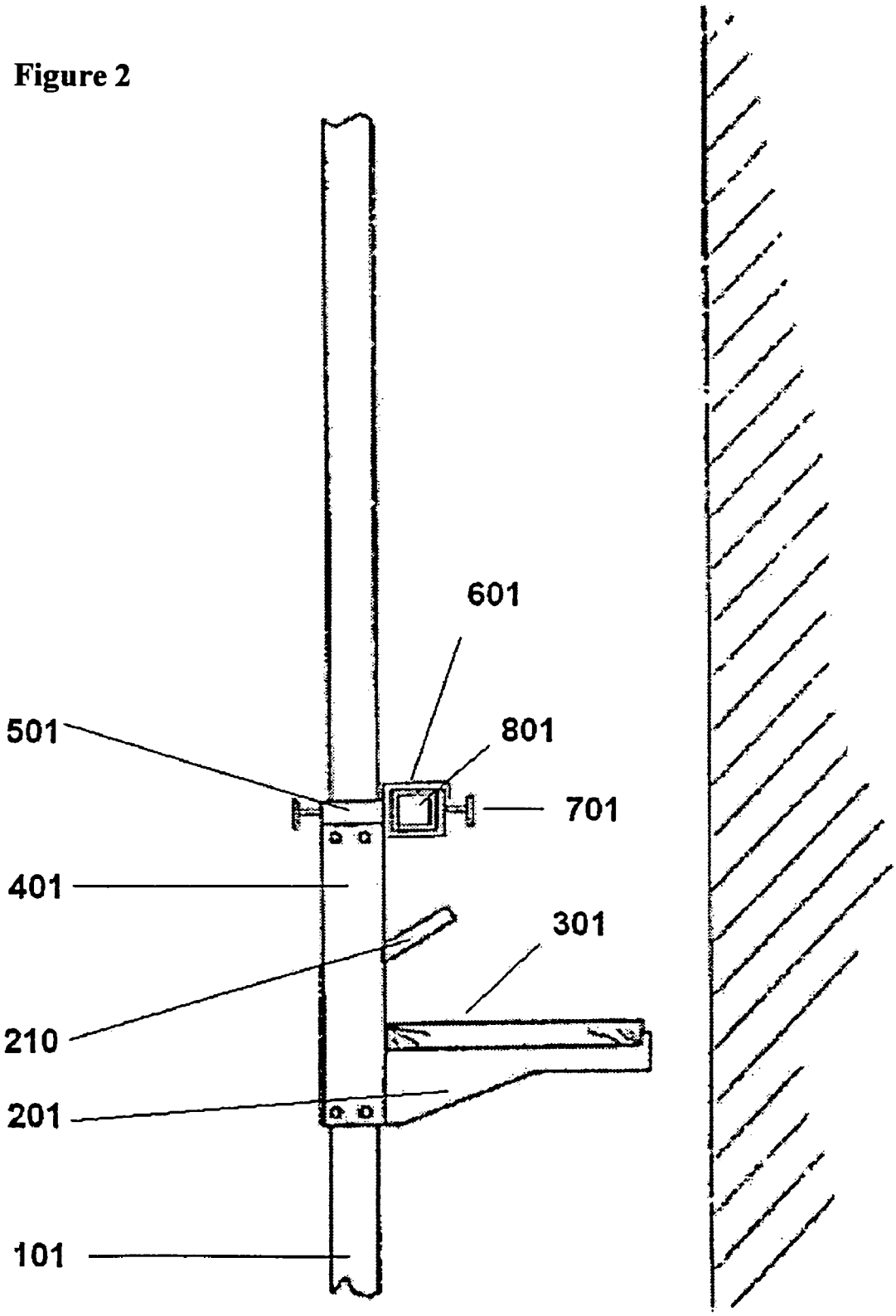
FIG. 2: Side view of scaffolding system showing the provided scaffold safety railing device.
Figure 3:
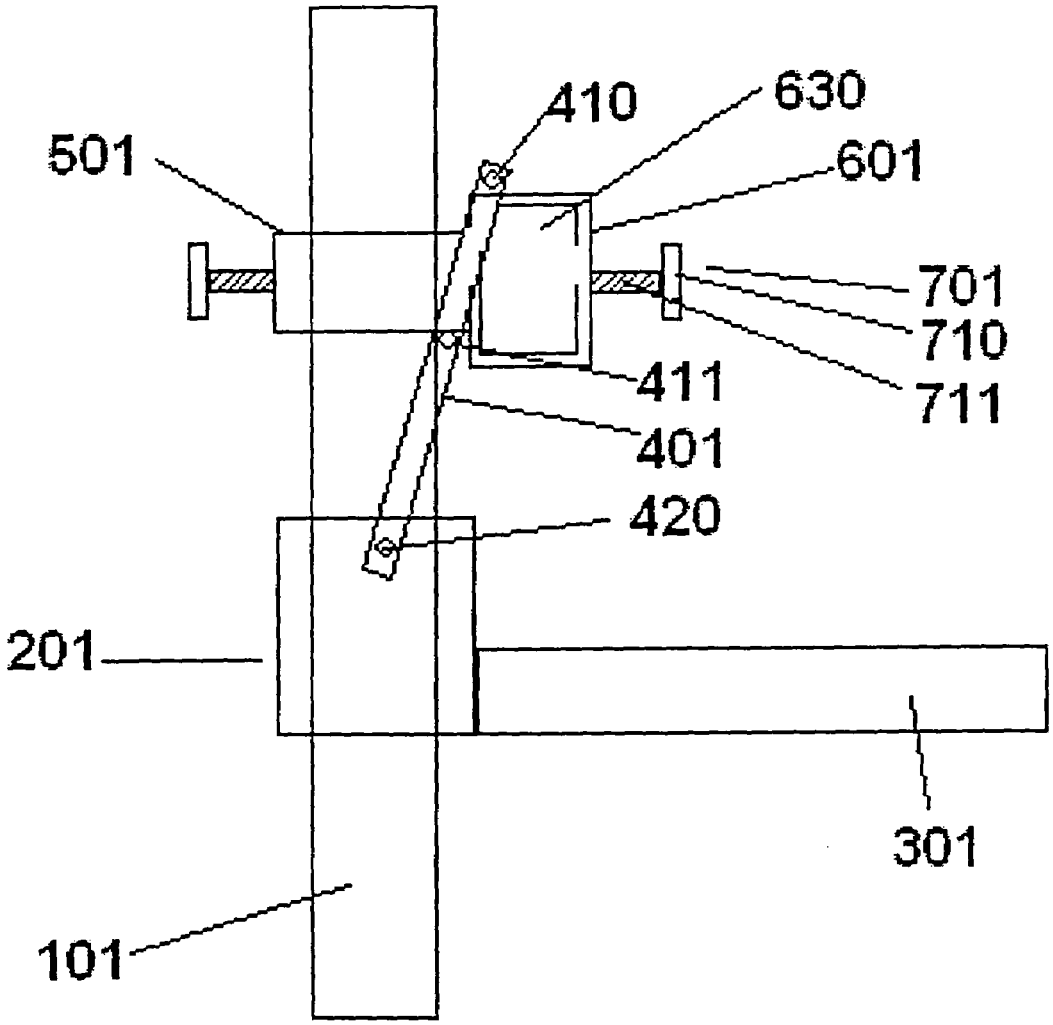
FIG. 3: Side view of safety railing device showing independent vertical spacer attached to pump jack.
Figures 4, 4A, 4B:
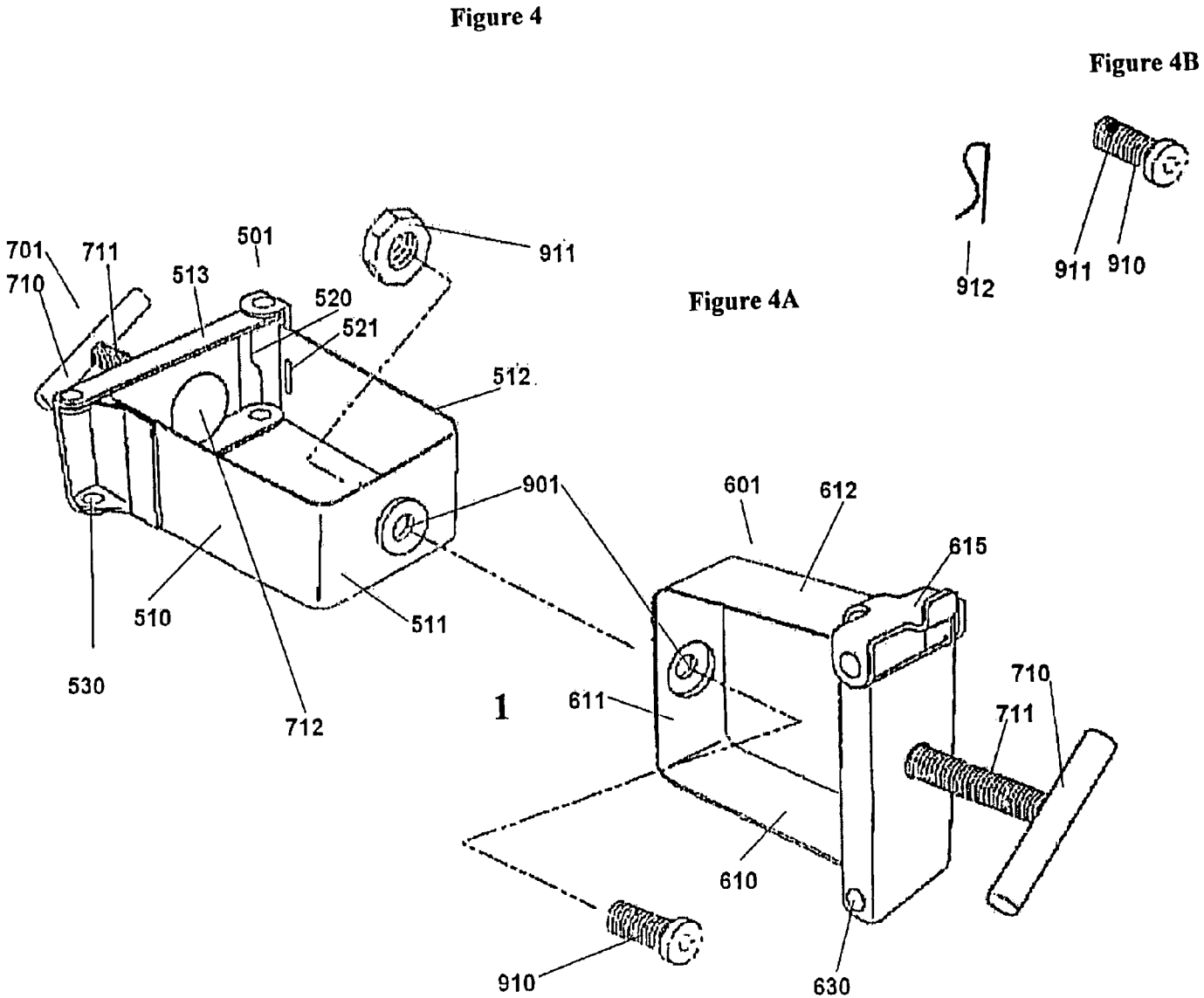
FIGS. 4A–B.

Referring now to the drawings (FIGS. 1–5) wherein like numerals refer to like and corresponding parts throughout the several views, the present invention provides as shown in FIG. 1 and FIG. 2, a scaffold safety railing device assembly comprising at least two vertical support poles 101; a safety rail 801; at least two vertical pole safety rail support clamp devices 501 together with 601 (collectively designated 1), wherein one vertical support pole 101 is inserted through a first pole clamp 601 and a second vertical support pole 101 is inserted through a second first pole clamp 601 and wherein the safety rail 801 is inserted through a second pole clamp 501 and through the second second pole clamp 501. A pump jack support device 201 is attached to each vertical support pole 101 by a clamp device. A portion of the pump jack support device 201 extends outward from the vertical pole in the horizontal plane, forming a support platform to hold up a scaffold 301. The pump jack support device further comprises a pump jack lever 210 which when depressed will cause the pump jack device 201 to raise its relative position along the vertical pole 101 in the vertical plane. A vertical spacer 401 is attached to the pump jack device in a position parallel to the vertical pole 101. According to another embodiment and as shown in FIG. 3, the spacer 401 may be positioned in a vertical orientation, which is not parallel to the vertical support pole 101. The attachment may be by means of a fastener such as a bolt, screw, rivet, weld or another fastening means which may be removable or non-removable. According to one embodiment of this invention, the spacer 401 further comprises a plurality of apertures 410, 411, 420 suitable for facilitating attachment to the pump jack support device 201 and the vertical pole safety rail support clamp device 1. The spacer 401 is also connected to the vertical pole safety rail support clamp device 1 which itself is comprises of a first pole clamp 501 pivotably attached to a second pole clamp 601. The spacer 401 may be attached to the vertical pole safety rail support clamp device 1 by means of a fastener such as a bolt, screw, rivet, weld or another fastening means which may be removable or non-removable. According to one embodiment of this invention, the spacer 401 is attached to the first pole clamp 501. According to another embodiment of this invention, the spacer 401 is attached to the second pole clamp 601. According to still another embodiment of the invention, the spacer may be positioned along the scaffold side of the vertical pole 101. According to yet another embodiment of this invention, the spacer may be positioned along the outside of the vertical pole 101. According to a preferred embodiment of this invention, the spacer is positioned in a recess between the first pole clamp 501 and the second pole clamp 601 without need for a fastener. According to this embodiment, stable contact between the spacer 401 and the vertical pole safety rail support clamp device 1 is sufficient to lift the safety rail simultaneously with pump jack mediated lifting of the scaffold. An adjustment means 701 on each of the first pole clamp 501 and the second pole clamp 601 facilitates tightening or loosening of the respective pole clamps around the vertical support pole 101 or the safety railing 801, thereby permitting quick and easy assembly or positional adjustment. As shown in FIG. 4, the adjustment means 701 comprises a threaded member 711 having an approximately flat abutment end 712 and a handle end 710.

Turning to FIG. 4, FIG. 4A shows the first pole clamp 501, circumscribing a generally rectangular perimeter, the first pole clamp 501 comprising a generally U-shaped bar having a first side 510; a second side 511 and a third side 512, wherein the first and third sides are approximately parallel to each other and the third side is approximately perpendicular to the first and third sides and wherein the second side 511 further comprises an aperture 901; and a fourth side 513 removably attached to the first 510 and third sides 512 opposite and approximately parallel the second side 511.

FIG. 4A shows the second pole clamp 601, circumscribing a generally rectangular perimeter, the first pole clamp 601 comprising a generally U-shaped bar having a first side 610; a second side 611 and a third side 612, wherein the first and third sides are approximately parallel to each other and the third side is approximately perpendicular to the first and third sides and wherein the second side 611 further comprises an aperture 901; and a fourth side 613 removably attached to the first 610 and third sides 612 opposite and approximately parallel the second side 611.

FIG. 4A further shows the pole clamp connecting fastening means 910 which may be stably inserted through the aperture 901 of the second side 511 of the first pole clamp 501 and through the aperture 901 of the second side 611 of the second pole clamp 601, wherein the first pole clamp 501 and the second pole clamp 601 are able to pivotably rotate about the axis formed by the pole clamp connecting fastener 910.

According to a preferred embodiment of this invention as shown in FIG. 4B, the pole clamp connecting fastening means 910 further comprises an aperture 911 through which a locking device 912 such as a cotter pin may be inserted in order to preclude inadvertent removal of the pole clamp connecting fastening means 910 and subsequent separation of the first pole clamp device 501 from the second pole clamp device 601.

Figure 5:
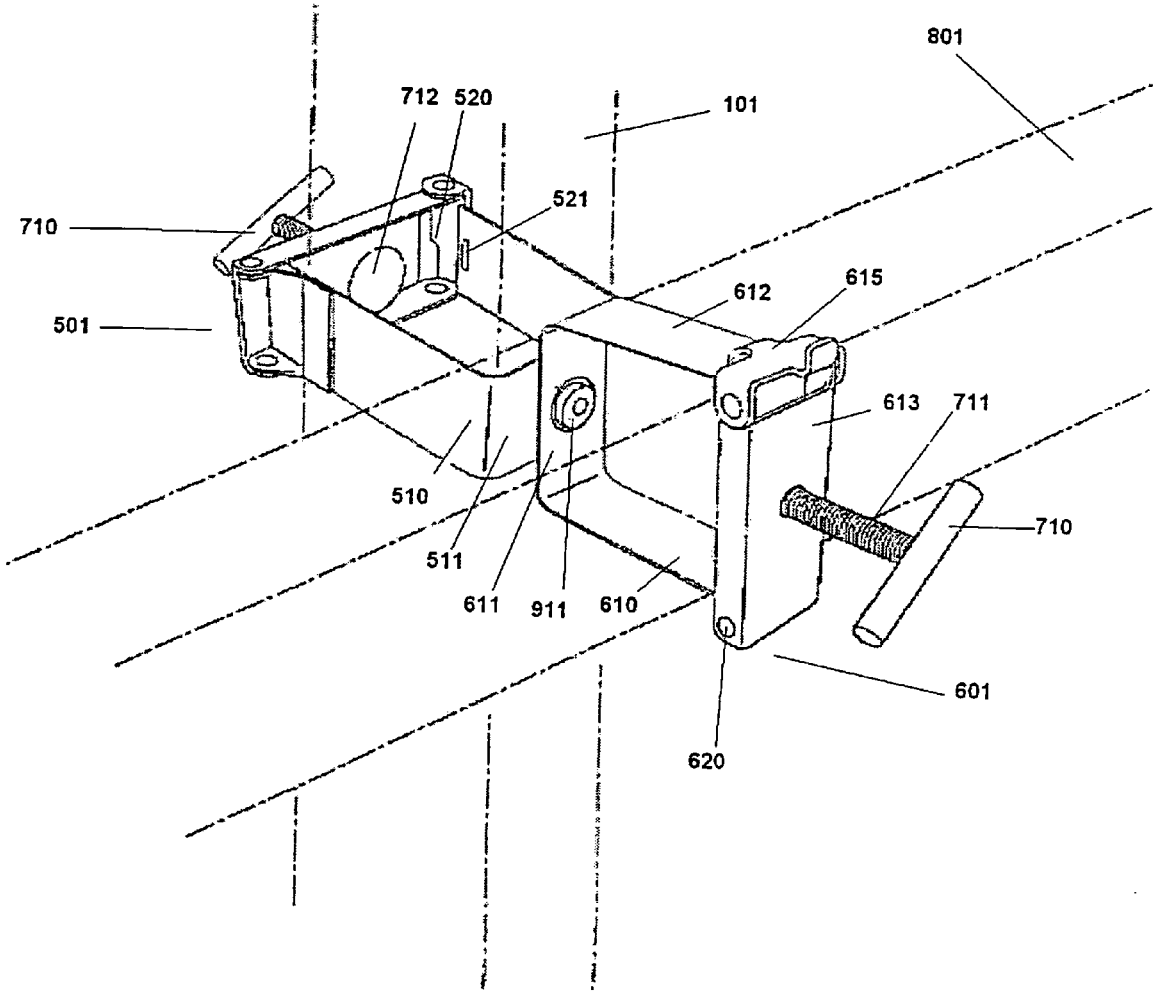
FIG. 5: View of support clamp device 1 showing pivotably joined first pole clamp and second pole clamp with inserted vertical pole and inserted safety rail.

FIG. 5 shows the pivotably joined first pole clamp 501 and second pole clamp 601 with inserted vertical pole 101 and inserted safety rail 801. According to a preferred embodiment of this invention, the fourth side 513 of the first pole clamp 501 is attached to the first side 510 and the third side 512 by a pivotable hinge means 520 thereby facilitating movement of the fourth side 513 creating an opening for quick and easy removal of the first pole clamp from the vertical support pole 101. According to a preferred embodiment of this invention, the fourth side 513 is secured to the third side 512 by means of a latch 520 inserted into an aperture 521 on the third side 512.

Similarly, according to a preferred embodiment of this invention, the fourth side 613 of the second pole clamp 601 is attached to the first side 610 and the third side 611 by a pivotable hinge means 630 thereby facilitating movement of the fourth side 613 creating an opening for quick and easy removal of the second pole clamp from the safety rail 801. According to a preferred embodiment of this invention, the fourth side 613 is secured to the third side 612 by means of a latch 615 inserted into an aperture 621 on the third side 612.

The descriptions, examples and embodiments described herein are presented in order to more fully illustrate preferred embodiments of the invention. They should in no way be construed, however, as limiting the broad scope of the invention. While the invention is described and illustrated herein by references to various specific material, procedures and examples, it is understood that the invention is not restricted to the particular material combinations of material, and procedures selected for that purpose. Numerous variations of such details can be implied as will be appreciated by those skilled in the art.

REFERENCES

1 U.S. Pat. No. 6,131,698, "Scaffolding Assembly";
2 U.S. Pat. No. 6,015,028, "Pump Jack Hoisting Apparatus Including A Safety Railing For Protecting Workers From Accidental Falling";
3 U.S. Pat. No. 6,000,495, "Scaffolding System";
4 U.S. Pat. No. 5,829,549, "Walkway With Rail System";
5 U.S. Pat. No. 5,560,730, "Scaffold System";
6 U.S. Pat. No. 4,984,654, "Scaffold Safety System";
7 U.S. Pat. No. 4,856,616, "Railing Support Clamp For Scaffold";
8 U.S. Pat. No. 4,869,343, "Railing Assembly For Scaffold";
9 U.S. Pat. No. 4,741,505, "Scaffolding Platform";
10 U.S. Pat. No. D391,150, "Scaffolding Platform";
11 U.S. Pat. No. 4,624,342, "Scaffolding Platform";
12 U.S. Pat. No. 4,598,794, "Scaffolding Platform";
13 U.S. Patent App. No. 2004/0041141, "Temporary Safety Guard Rail System";
14 U.S. Patent app. No. 2004/0163889, "Device For Human Protection In Scaffolding".

What is claimed is:

1. A support clamp device for a scaffold safety railing adapted for mounting on a pump jack pole comprising:

a. a first pole clamp, circumscribing a generally rectangular perimeter, the first pole clamp comprising:
   i. a generally U-shaped bar having a first side; a second side and a third side, wherein the first and third sides are approximately parallel to each other and the second side is approximately perpendicular to the first and third sides and wherein the second side further comprises an aperture; and
   ii. a fourth side removably attached to the first and third sides opposite and approximately parallel the second side; and b. a second pole clamp, circumscribing a generally rectangular perimeter, the second pole clamp comprising:
   i. a generally U-shaped bar having a first side; a second side and a third side, wherein the first and third sides are approximately parallel to each other and the second side is approximately perpendicular to the first and third sides and wherein the second side further comprises an aperture; and
   ii. a fourth side removably attached to the first and third sides opposite and approximately parallel the second side; and c. a pole clamp connecting fastening means stably inserted through the aperture of the second side of the first pole clamp and through the aperture of the second side of the second pole clamp, wherein the first pole clamp and the second pole clamp are able to pivotably rotate about the axis formed by the pole clamp connecting fastener; and d. a vertical spacer, wherein the spacer has a scaffold joining end and a support clamp joining end, wherein the support clamp joining end is joined to the support clamp device in a position between the first pole clamp and the second pole clamp and the scaffold joining end extends away from the support clamp device.

2. The support clamp device of claim 1 wherein the vertical spacer is stably attached to the support clamp device.

3. The support clamp device of claim 1, wherein the vertical spacer further comprises a plurality of apertures.

4. The support clamp device of claim 1, wherein the vertical spacer is reversibly attached to the support clamp device.

5. The support clamp device of claim 1, wherein the vertical spacer is comprised of metal.

6. The support clamp device of claim 5, wherein the vertical spacer is comprised of steel.

7. The support clamp device of claim 1 wherein the fourth side of the first pole clamp further comprises an aperture.

8. The support clamp device of claim 1, further comprising a adjusting means, wherein the adjusting means comprises a threaded member having an approximately flat abutment end and an opposite handle end, wherein the adjusting means is threaded through the aperture and is capable of tightening the support clamp about a beam.

9. The support clamp device of claim 1, wherein the fourth side of the first pole clamp further comprises a hinge at one connected to the third side of the first pole clamp and a latch at the opposite end capable of stably hooking an aperture on the first side of the first pole clamp, facilitating the opening of the fourth side of the first pole through an angle from approximately perpendicular to the third side of the first pole clamp through an angle approximately parallel to the third side of the first pole clamp.

10. The support clamp device of claim 1, wherein the fastening means is a nut and bolt.

11. The support clamp device of claim 1, wherein the fastening means is a rivet.

12. The support clamp device of claim 1, wherein the fastening means is a pin with a cotter pin.

13. A safety railing assembly comprising:

a. at least two vertical support poles;

b. a safety rail comprising a first end and a second end;

c. at least two support clamp devices of claim 2, wherein one vertical support pole is inserted through one first pole clamp and a second vertical support pole is inserted through a second first pole clamp and wherein the first end of the safety rail is inserted through one second pole clamp and the second end of the safety rail is inserted through the second second pole clamp;

d. a pair of pump jack hoisting apparatus, wherein each pump jack apparatus is mounted on a compatible vertical support pole; and e. said spacer is vertically connected between the pump jack and the support clamp device, stabilizing the position between the support clamp device and the pump jack assembly.

14. The safety railing assembly of claim 13 wherein the spacer is metal.

15. The safety railing assembly of claim 13 wherein the safety rail is metal.

16. The safety railing assembly of claim 13 wherein the safety rail is wood.

17. The safety railing assembly of claim 13 wherein the safety rail is plastic.

* * * * *